US009642204B2

(12) United States Patent
Puvanakijjakorn et al.

(10) Patent No.: US 9,642,204 B2
(45) Date of Patent: May 2, 2017

(54) DIMMABLE MULTICHANNEL DRIVER FOR SOLID STATE LIGHT SOURCES

(71) Applicants: Voravit Puvanakijjakorn, Beverly, MA (US); Masatoshi Honji, Westborough, MA (US); Anne Janet Milliez, Brighton, MA (US)

(72) Inventors: Voravit Puvanakijjakorn, Beverly, MA (US); Masatoshi Honji, Westborough, MA (US); Anne Janet Milliez, Brighton, MA (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 14/800,772

(22) Filed: Jul. 16, 2015

(65) Prior Publication Data

US 2015/0319820 A1 Nov. 5, 2015

Related U.S. Application Data

(62) Division of application No. 13/799,885, filed on Mar. 13, 2013, now Pat. No. 9,119,250.
(Continued)

(51) Int. Cl.
*H05B 33/08* (2006.01)

(52) U.S. Cl.
CPC ..... *H05B 33/0851* (2013.01); *H05B 33/0803* (2013.01); *H05B 33/089* (2013.01);
(Continued)

(58) Field of Classification Search
CPC ..... H05B 33/0815; H05B 33/0896
See application file for complete search history.

(56) References Cited

U.S. PATENT DOCUMENTS 7,402,961 B2 * 7/2008 Bayat ..... F21L 4/02 315/295
2007/0091036 A1 4/2007 Han et al.
(Continued)

FOREIGN PATENT DOCUMENTS

EP 2 094 063 A1 8/2009

OTHER PUBLICATIONS

L6562 Transition-Mode PFC Controller, Nov. 2005, pp. 1-16, STMicroelectronics, Geneva, Switzerland.
(Continued)

*Primary Examiner* — Douglas W Owens
*Assistant Examiner* — Pedro C Fernandez
(74) *Attorney, Agent, or Firm* — Shaun P. Montana

(57) ABSTRACT

Systems and methods for driving solid state light sources are provided. A first drive circuit is configured to generate a drive current to cause a first solid state light source load and a second solid state light source load to illuminate. A feedback and control circuit is configured to receive feedback from the first solid state light source load and to control the drive current through the first solid state light source load based on the feedback. A second drive circuit is configured to control the drive current through the second solid state light source load. A master controller is configured to provide a first input to the feedback and control circuit to control the drive current through the first solid state light source load and a second input to the second drive circuit to control the drive current through the second solid state light source load.

7 Claims, 8 Drawing Sheets

Related U.S. Application Data

(60) Provisional application No. 61/643,222, filed on May 4, 2012.

(52) U.S. Cl.
CPC ..... *H05B 33/0815* (2013.01); *H05B 33/0845* (2013.01); *H05B 33/0857* (2013.01); *H05B 33/0896* (2013.01)

(56) References Cited

U.S. PATENT DOCUMENTS

2010/0033109 A1* 2/2010 Liu ..... H05B 33/0827 315/294
2011/0057573 A1 3/2011 Jutras et al.
2011/0204778 A1* 8/2011 Sadwick ..... H05B 33/0827 315/34
2011/0316447 A1* 12/2011 Liu ..... G09G 3/3406 315/297
2013/0099684 A1* 4/2013 Cheng ..... H05B 33/0818 315/186

OTHER PUBLICATIONS 8-bit AVR Microcontroller with 2/4/8K Bytes In-System Programmable Flash ATtiny261/V ATtiny461/V ATtiny861/V, Aug. 2010, pp. 1-242, 2588E-AVR-08/10, Atmel Corporation, San Jose, California, United States of America.
LM3414/LM3414HV 1A 60W* Common Anode Capable Constant Current Buck LED Driver Requires No External Current Sensing Resistor, Nov. 2, 2011, pp. 1-20, Texas Instruments Incorporated, Dallas, Texas, United States of America.
Anna-Maria Brosa, International Search Report and Written Opinion of the International Searching Authority for PCT/US2013/039371, Jan. 17, 2014, pp. 1-17, European Patent Office, Rijswijk, The Netherlands.

* cited by examiner

DIMMABLE MULTICHANNEL DRIVER FOR SOLID STATE LIGHT SOURCES

CROSS-REFERENCE TO RELATED APPLICATIONS

The present application is a divisional of U.S. patent application Ser. No. 13/799,885, filed Mar. 13, 2013 and entitled "DIMMABLE MULTICHANNEL DRIVER FOR SOLID STATE LIGHT SOURCES", which claims priority of U.S. Provisional Patent Application No. 61/643,222, filed May 4, 2012 and entitled "DRIVER CIRCUIT FOR SOLID STATE LIGHT SOURCE LAMP", the entire contents of both of which are hereby incorporated by reference.

TECHNICAL FIELD

The present invention relates to lighting, and more specifically, to electronic circuits for solid state light sources.

BACKGROUND

A conventional light source such as, for example, an incandescent lamp or halogen lamp, when dimmed, acts like a near exact black body radiator and follows the Planckian curve on the 1931 CIE Chromaticity Diagram. For example, a conventional incandescent lamp at its maximum output may output light having a color temperature of 3000K. As that incandescent lamp is dimmed (e.g., through use of a triac dimmer), the current running through its filament is reduced, resulting in a lower, warmer color temperature (e.g., 2000K).

As solid state light sources become more widely used, lighting designers and lighting consumers desire that the solid state light sources behave similarly to conventional light sources. However, unlike an incandescent lamp or a halogen lamp, solid state light sources typically hold their color temperature as they are dimmed. This behavior has been overcome to a degree by using a color mixing technique. A two channel controllable current solid state light source driver performs color mixing between two strings of solid state light sources to achieve incandescent-like dimming (i.e., dimming at or substantially near the Planckian curve), as desired by the market. An example of such a lamp is the Philips® Master LEDspotMV GU10 Dim Tone lamp, which was designed to operate at 220V/230V systems with a triac dimmer.

SUMMARY

At least one problem with the above-referenced Philips® LED lamp is the loss of certain resistors in terms of efficiency, and the dependent LED current control based on the power transfer through the transformer. With these two resistors, the voltage across the two strings of solid state light sources (e.g., white LEDs and amber LEDs) can be equal, which does not force a string to turn off. For example, if high current is provided to the amber LED string, the loss of the resistor will be significantly high. The circuit also does not have any feedback loop to the primary side of the transformer (e.g., to reduce or increase the energy transfer to the secondary side). Therefore, the current between two strings of solid state light sources needs to be shared according to the power transfer from the primary.

Embodiments overcome these and other deficiencies by providing a dimmable multichannel driver for solid state light sources. Embodiments allow at least two solid state light source loads to be driven in a manner that allows for control of the current flowing through the solid state light source loads to generate illumination at a desired light color temperature.

In an embodiment, there is provided a power supply circuit. The power supply circuit includes: a first drive circuit configured to generate a drive current to cause a first solid state light source load and a second solid state light source load to illuminate; a feedback and control circuit configured to receive feedback from the first solid state light source load and to control the drive current through the first solid state light source load based on the feedback; a second drive circuit configured to control the drive current through the second solid state light source load; and a master controller configured to provide a first input to the feedback and control circuit to control the drive current through the first solid state light source load and a second input to the second drive circuit to control the drive current through the second solid state light source load.

In a related embodiment, the first drive circuit may include a direct current (DC) to DC flyback converter circuit including a flyback converter controller. In a further related embodiment, the feedback and control circuit may be configured to compare a voltage corresponding to actual drive current through the first solid state light source load to a reference voltage and to control the first drive circuit based on the difference between the voltage corresponding to the actual drive current and the reference voltage.

In a further related embodiment, the feedback and control circuit may include an operational amplifier and an optical isolator configured to generate a control signal based on the difference between the voltage corresponding to the actual drive current and the reference voltage, and the flyback converter controller may be configured to control the drive current generated by the first drive circuit based on the control signal.

In another further related embodiment, the feedback and control circuit may be configured to generate a voltage corresponding to the voltage across the first solid state light source load based on the actual drive current, and the master controller may be configured to adjust the reference voltage based on the voltage corresponding to the voltage across the first solid state light source load.

In yet another further related embodiment, the first input may be a first pulse width modulation (PWM) signal to the feedback and control circuit to generate the reference voltage and the second input may be a second PWM signal to the second drive circuit. In a further related embodiment, the second drive circuit may include a DC to DC buck controller configured to control the drive current for the second solid state light source load based on the second PWM signal. In another further related embodiment, the power supply circuit may further include a front end circuit configured to generate a DC voltage based on an alternating current (AC) input, wherein the front end circuit may be further configured to provide the generated DC voltage to the first drive circuit. In a further related embodiment, the front end circuit and the first drive circuit may include a two stage low pass EMI filter and rectifier circuit. In another further related embodiment, the power supply circuit may further include a dimmer sense circuit configured to generate a dimmer sense voltage based on a phase cut voltage sensed in the DC voltage generated by the front end circuit. In a further related embodiment, a frequency of the first PWM signal and a frequency of the second PWM signal may each be selected from predetermined settings stored in the master controller, wherein the frequencies being selected are based on the dimmer sense voltage. In a further related embodiment, the first solid state light source load may include solid state light sources of a first color and the second solid state light source load may include solid state light sources of a second color, and the predetermined settings may be configured to cause the first solid state light source load and the second solid state light source load to generate light, that when combined, corresponds to a certain light color temperature.

In another embodiment, there is provided a method. The method includes: determining if a first solid state light source load driven by a first drive circuit is illuminated based on a voltage corresponding to the voltage across the first solid state light source load generated in a feedback and control circuit; and controlling the first drive circuit based on the voltage corresponding to the voltage across the first solid state light source load by adjusting a reference voltage in the feedback and control circuit.

In a related embodiment, determining may include determining if a first solid state light source load driven by a direct current (DC) to DC flyback circuit is illuminated based on a voltage corresponding to the voltage across the first solid state light source load generated in the feedback and control circuit, wherein the DC to DC flyback circuit includes a DC to DC flyback converter controller; and controlling may include controlling the DC to DC flyback circuit based on the voltage corresponding to the voltage across the first solid state light source load by adjusting a reference voltage in the feedback and control circuit. In another related embodiment, adjusting the reference voltage may include adjusting a first pulse width modulation (PWM) signal provided to the feedback and control circuit to generate the reference voltage. In a further related embodiment, the method may further include receiving a dimmer sense voltage from a dimmer sense circuit; determining a first duty cycle for the first PWM signal based on the dimmer sense voltage; and providing the first PWM signal at the first duty cycle to the feedback and control circuit. In a further related embodiment, the method may further include determining a second duty cycle for a second PWM signal based on the dimmer sense voltage; and controlling a second drive circuit configured to drive a second solid state light source load by providing the second PWM signal at the second duty cycle to the second drive circuit.

In a further related embodiment, controlling a second drive circuit may include controlling a DC to DC buck controller, the DC to DC buck controller being configured to control the drive current for the second solid state light source load based on the second PWM signal.

In another further related embodiment, determining the first duty cycle and determining the second duty cycle may include selecting a first frequency for the first PWM signal and a second frequency for the second PWM signal, wherein each frequency is selected from predetermined settings stored in a master controller, and wherein each frequency is selected based on the dimmer sense voltage. In a further related embodiment, selecting may include selecting a first frequency for the first PWM signal and a second frequency for the second PWM signal, wherein each frequency is selected from predetermined settings stored in a master controller, wherein each frequency is selected based on the dimmer sense voltage, and wherein the predetermined settings are configured to cause the first solid state light source load and the second solid state light source load to generate light, that when combined, corresponds to a certain light color temperature.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

Although the following Detailed Description will proceed with reference being made to illustrative embodiments, many alternatives, modifications, and variations thereof will be apparent to those skilled in the art.

DETAILED DESCRIPTION

As used throughout, the term "solid state light source" includes light sources including, for example but not limited to, one or more light emitting diodes (LEDs), organic light emitting diodes (OLEDs), polymer light emitting diodes (PLEDs) or any other solid state device configured to emit light, and/or combinations thereof. Moreover, "solid state light source load" refers to an arrangement of one or more solid state light sources within another device (e.g., lamp, light engine, fixture, etc.).

Figure 1:
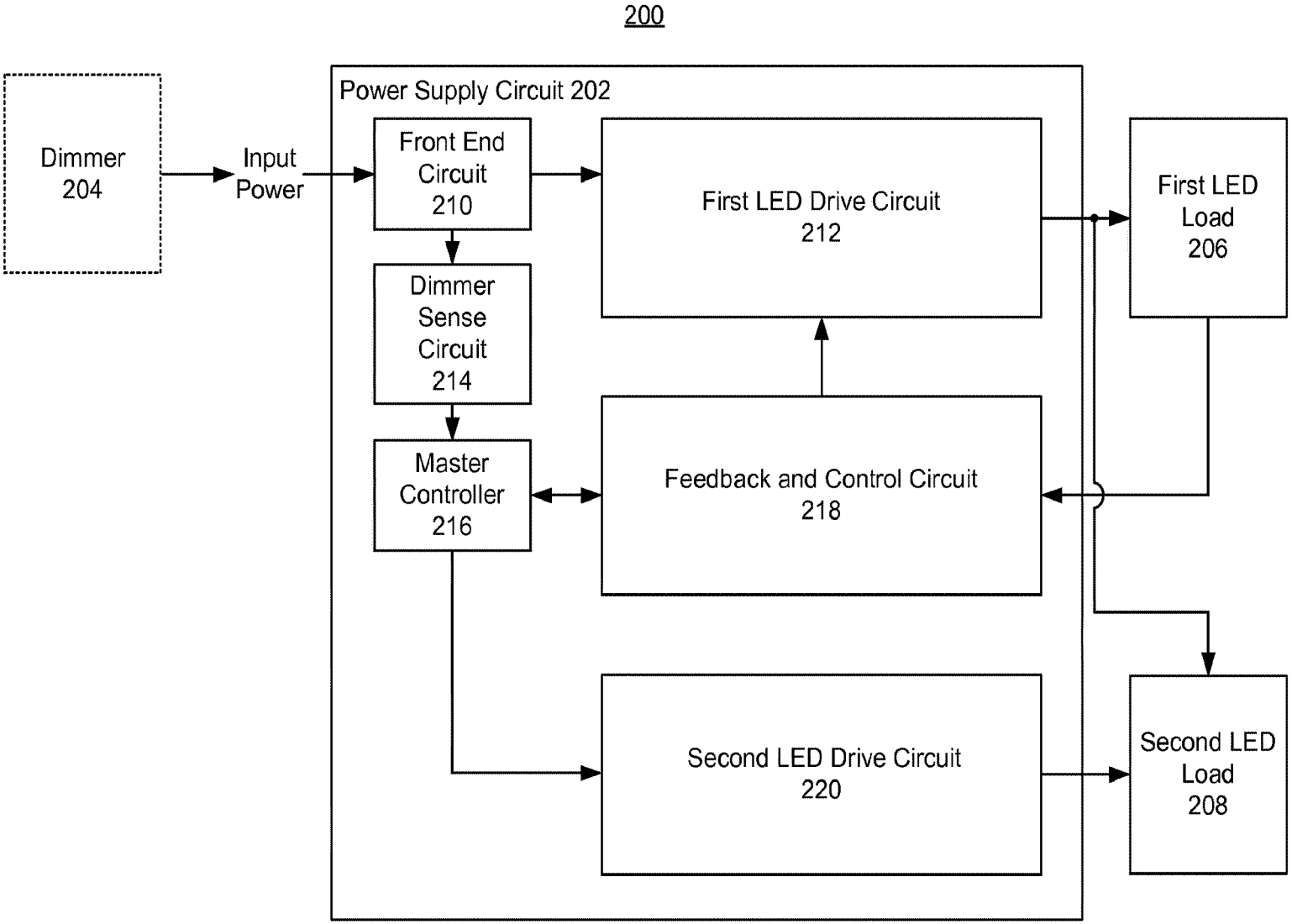
FIG. 1 shows a block diagram of a dimmable multichannel driver according to embodiments disclosed herein.

FIG. 1 is a block diagram of a dimmable multichannel driver system 200 that includes a power supply circuit 202 configured to receive input power from a dimmer 204 and to drive at least a first solid state light source load 206 and a second solid state light source load 208 (also referred to throughout as a first LED load 206 and a second LED load 208). The power supply circuit 202 includes a front end circuit 210, a first solid state light source drive circuit 212 (also referred to throughout as a first LED drive circuit 212), a dimmer sense circuit 214, a master controller 216, a feedback and control circuit 218, and a second solid state light source drive circuit 220 (also referred to throughout as a second LED drive circuit 220). The dimmer 204 is not a core component of embodiments and thus is shown as optional in FIG. 1, but would be employed with some embodiments. For example, in some embodiments, the dimmer 204 includes an alternating current (AC) triac-based dimming circuit, configured as either a leading edge or a trailing edge dimmer, or both.

The front end circuit 210 may be, and in some embodiments is, configured to generate a DC voltage based on an input power (for example but not limited to an AC input voltage provided by the dimmer 204). The DC voltage generated by the front end circuit 210 is then provided to at least the first LED drive circuit 212, which is configured to generate a drive current for the first LED load 206 and the second LED load 208 based on the generated DC voltage. In some embodiments, the first LED drive circuit 212 includes a DC to DC flyback converter circuit controlled by a flyback controller. In some embodiments, the dimmer sense circuit 214 is configured to determine a dimmer sense voltage based on the generated DC voltage. In some embodiments, a phase cut voltage component present in the DC voltage causes the dimmer sense circuit 214 to generate the dimmer sense voltage. The dimmer sense voltage is then provided to the master controller 216. The master controller 216 senses a voltage generated by the feedback and control circuit 218 (e.g., a voltage corresponding to the voltage across the first LED load 206).

Based on the dimmer sense voltage and/or the voltage corresponding to the voltage across the first LED load 206, the master controller 216 is configured to provide a first input to the feedback and control circuit 218 and a second input to the second LED drive circuit 220. The first input, in some embodiments, is a first PWM signal configured to cause the feedback and control circuit 218 to generate a reference voltage. In some embodiments, the feedback and control circuit 218 is configured to generate a voltage corresponding to the actual drive current through the first LED load 206, and to compare this voltage to the reference voltage. The resulting difference between the voltage corresponding to the actual drive current and the reference voltage is provided to the first LED drive circuit 212. In some embodiments, the difference serves as one or more control signals to the flyback controller of the first LED drive circuit 212, the flyback controller being configured to control the first LED drive circuit 212 based on one or more the control signals. The second PWM signal is provided to the second LED drive circuit 220. In some embodiments, a buck controller in the second LED drive circuit 220 is configured to control the current flowing through the second LED load 208 based on the second PWM signal. More specifically, the drive current for the second LED load 208 is provided by the first LED drive circuit 212, however, current flow through the second LED load 208 may be, and in some embodiments is, controlled by the second LED drive circuit 220. For example, the current flow through the second LED load 208, in some embodiments, is restricted to be less than the current flow through the first LED load 206, so that the second LED load 208 appears dimmer than the first LED load 206. This results in a desired color temperature for the combined light emitted by both the first LED load 206 and the second LED load 208.

In this regard, the frequencies of the first PWM signal and the second PWM signal may be, and in some embodiments are, selected from predetermined settings in the master controller 216 based on, for example but not limited to, the dimmer sense voltage and/or the voltage corresponding to the voltage across the first LED load 206. In some embodiments, the dimmer sense voltage provides a baseline amount of light output that is desired (e.g., as dictated by the setting of the dimmer 204), and this baseline amount may be adjusted to account for actual device performance based on feedback (e.g., the voltage across the first LED load 206). In some embodiments, the dimmer sense voltage is scaled by the master controller 216 to a digital value between, for example, 0 and 255 that is then used in selecting a record from a predetermined data array (e.g., also stored in the master controller 216). Each record in the data array corresponds to a "recipe" for generating a desired light color temperature from the combined light output of the first LED load 206 and the second LED load 208. A first value in the record may be the digital dimmer value, while a second value in the record may correspond to the first PWM signal duty cycle, and a third value in the record may correspond to the second PWM signal frequency.

FIGS. 2-7 are circuit diagrams of components of a power supply circuit, such as but not limited to the power supply circuit 202 shown in FIG. 1. Note that the circuit diagrams provided in FIGS. 2-7 have been provided merely for the sake of explanation herein, and are not intended to limit any of the disclosed embodiments to implementation using the only the depicted components in the depicted configuration. Similar to the power supply circuit 202 of FIG. 1, FIGS. 2-7 show, respectively, a front end circuit 210', a first LED drive circuit 212', a dimmer sense circuit 214', a master controller 216', a feedback and control circuit 218', and a second drive circuit 220'. A power supply circuit including these may be configured to drive any number of loads, though in FIGS. 6-7 it is shown as being configured to drive two loads (an LED Load 1 and an LED Load 2, which may be and in some embodiments are the first LED load 206 and the second LED load 208 shown in FIG. 1). In embodiments where loads include different colored solid state light sources (e.g., the LED Load 1 includes at least one white solid state light source and the LED Load 2 includes at least one amber solid state light source), the current through each load may be, and in some embodiments is, controlled to create combined output light of a certain color temperature. In addition, such a power supply circuit has a very high power factor (e.g., is very efficient), has low total harmonic distortion (THD) (e.g., has good isolation from noise), and supports both leading and trailing edge dimmers. Such a power supply circuit also has an output isolated for safe operation to meet Underwriter's Laboratories (UL) class 2 operational requirements. The functionality associated with each illustrated circuit 210'-220' are described further herein with respect to FIGS. 2-7.

Figure 2:
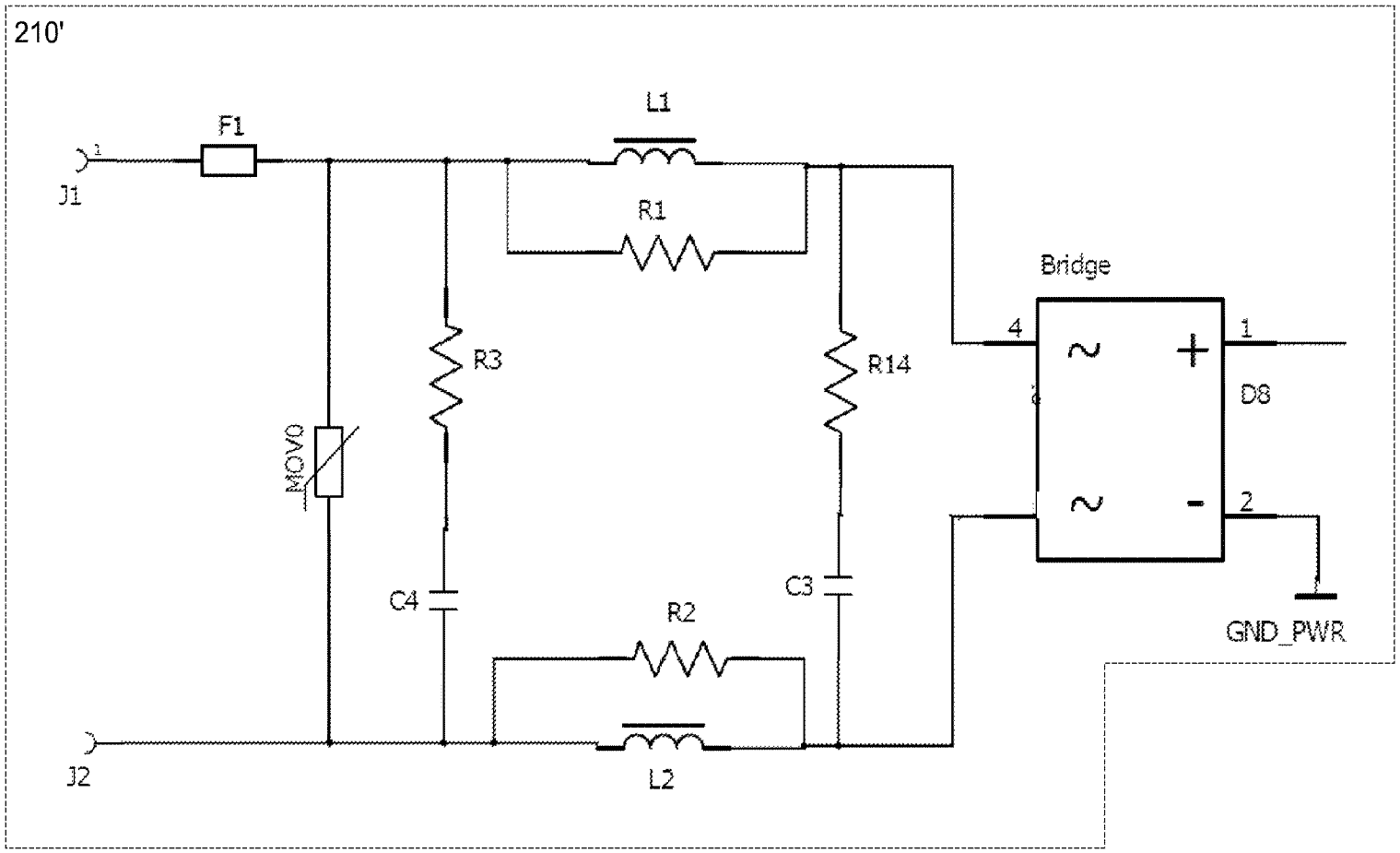
FIG. 2 illustrates a circuit diagram of a front end circuit of a dimmable multichannel driver according to embodiments disclosed herein.

FIG. 2 is a circuit diagram of the front end circuit 210'. The front end circuit 210' includes, for example but not limited to, a fuse F1, a metal oxide varistor (MOV) 0, resistors R1-R3 and R14, capacitors C3-C4, inductors L1-L2, and a bridge D8. An AC voltage (e.g., from the dimmer 204 of FIG. 1) is supplied to inputs J1 and J2. The fuse F1 is connected, on one side, to the input J1, and on its other side, to the MOV 0, to the resistor R3, and to the parallel combination of the inductor L1 and the resistor R1. The MOV 0 is also connected to the input J2. The resistor R3 is also connected to the capacitor C4, which is also connected to the input J2. The input J2 is also connected to the parallel combination of the resistor R2 and the inductor L2. The resistor R14 is connected in series with the capacitor C3. The capacitor C3 is connected to the parallel combination of the resistor R2 and the inductor L2, and to the bridge D8. The resistor R14 is connected to the parallel combination of the inductor L1 and the resistor R1, and to the bridge D8 (at pin 4). The components in the front end circuit 210', with the exception of the bridge D8, are configured to stabilize the input power and protect against interference from, for example, voltage spikes (e.g., from electrostatic discharge (ESD), lightning, etc.), electromagnetic interference (EMI), etc. The bridge D8 may be, and in some embodiments is, a bridge rectifier configured to rectify the incoming AC voltage into a DC voltage usable by the remainder of the power supply circuit 202'. The bridge D8, at pin 2, is connected to a GND_PWR, and at pin 1, is connected to the first LED drive circuit 212'.

Figure 3:
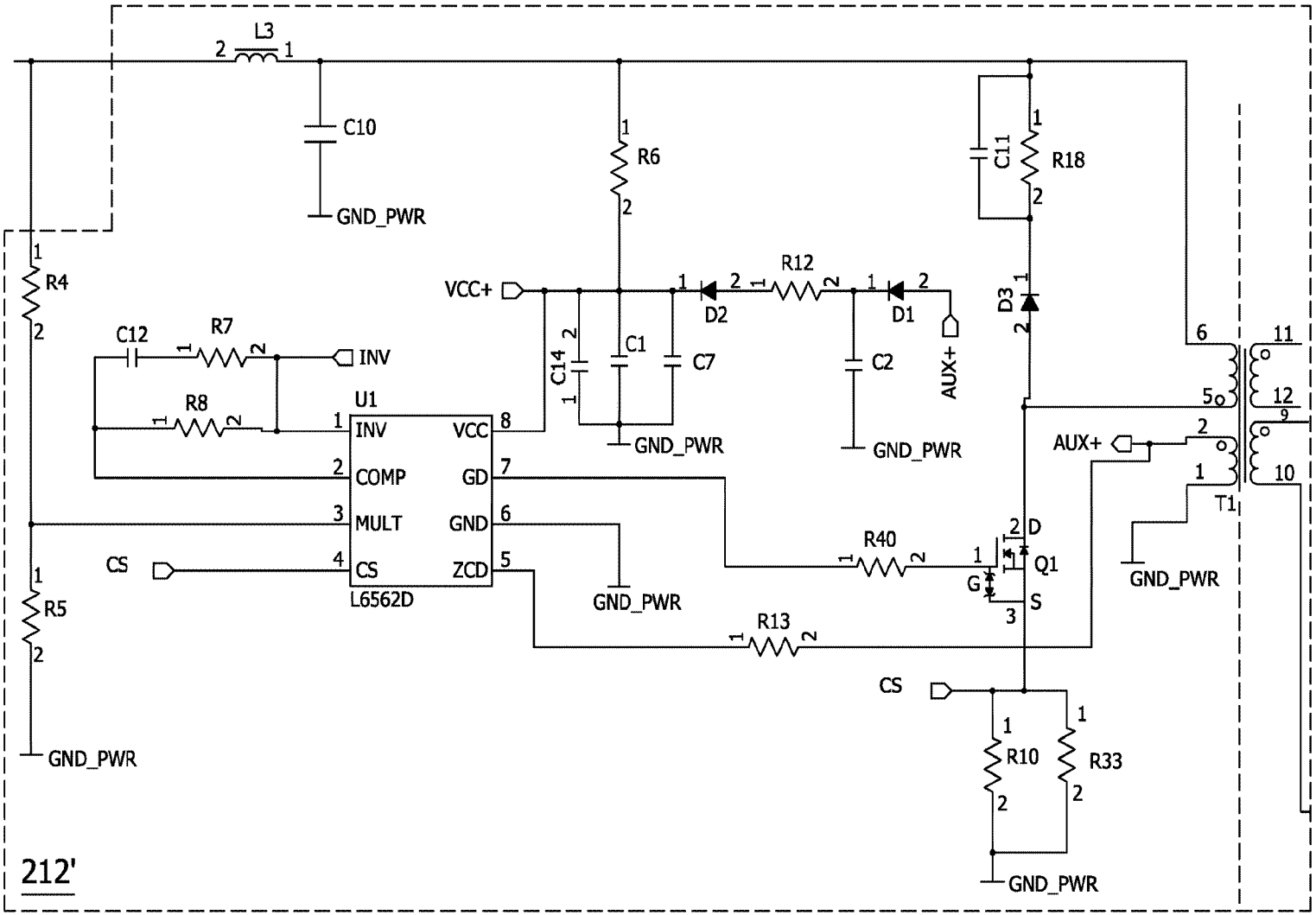
FIG. 3 illustrates a circuit diagram of a first solid state light source drive circuit of a dimmable multichannel driver according to embodiments disclosed herein.

FIG. 3 is a circuit diagram of the first LED drive circuit 212'. The first LED drive circuit 212' includes, for example but not limited to, resistors R4-R10, R12, and R33, capacitors C1-C2, C7, and C10-C12, an inductor L3, diodes D1-D3, a transformer T1, a transistor Q1, a Zener diode G, and a controller U1. Many of the components configured around the controller U1 may, and in some embodiments do, vary depending on the selected type of controller. The controller U1 shown in FIG. 3 and described herein is a L6562D Transition Mode PFC controller manufactured by ST Microelectronics Inc., though of course other controllers may be, and in some embodiments are, used. The controller U1 shown in FIG. 3 includes eight pins, numbered 1-8. Pin 6, the ground pin, is connected to ground. The remaining pins are as described herein.

The inductor L3 and the resistor R4 are each connected to the output pin 1 of the bridge D8 of the front end circuit 210' of FIG. 2. The resistor R4 is also connected to pin 3 of the controller U1 and to the resistor R5. The resistor R5 is also connected to ground. The inductor L3 is also connected to the capacitor C10, which is also connected to ground, and to the resistor R6, the parallel combination of the resistor R18 and the capacitor C11, and a primary winding (pin 5) of the transformer T1. The inductor L3 and the capacitor C10, along with the inductors L1 and L2, the resistors R3 and R14, and the capacitors C3 and C4 shown in FIG. 2, together operate as a two stage low pass EMI filter. The two stage low pass EMI filter is unique in that it may, and in some embodiments does, also damp ringing associated with triac dimmers. In some embodiments, the values for the components in the two stage low pass EMI filter are also chosen to adjust the phase angle between the input voltage and input current, which may result in low THD. One reason EMI may be so low with this configuration is that switching frequency is constantly changing, which spreads the noise over a wide band. The DC voltage generated by the front end circuit 210' at pin 1 of the bridge D8 is reduced via a voltage divider including the resistors R4 and R5, before being supplied to a multiplier input pin of the controller U1 (i.e., pin 3). The DC voltage is also provided to the primary winding (pins 5 and 6) of the transformer T1. The transformer T1 also includes secondary and bias windings. The turn ratio between the secondary and bias windings of the transformer T1 determines the bias voltage based upon the type of solid state light source selected for the first LED load 206 and the second LED load 208. Tight coupling between the primary winding and the secondary winding may be considered when selecting the transformer T1 to avoid losses due to leakage inductance. The parallel combination of the resistor R18 and the capacitor C11 are also connected in series with the diode D3, across the primary winding of the transformer T1. This helps to perpetuate the "flyback" response of the first LED drive circuit 212'.

The capacitors C14, C1, and C7 are connected in parallel with each other. The parallel combination of the capacitors C14, C1, and C7 is connected to ground, on one side, and to the resistor R6, a VCC+ input, and a cathode of the diode D2 on the other side. An anode of the diode D2 is connected to the resistor R12, which itself is connected to a cathode of the diode D1 and to the capacitor C2. The capacitor C2 is also connected to ground. An anode of the diode D1 is connected to an AUX input. The VCC+ input is also connected to a VCC input pin (pin 8) of the controller U1.

The resistor R7 is connected to an INV input. The resistor R7 and the capacitor C12 are connected in series. The series combination of the resistor R7 and the capacitor C12 are connected in parallel with the resistor R8, and both are connected, on one side, to an inverting input pin (pin 1) of the controller U1 and, on the other side, to a compensation input pin (pin 2) of the controller U1. A CS input is connected to a PWM comparator input pin (pin 4) of the controller U1.

A gate driver output pin (pin 7) of the controller U1 is connected to the resistor R9. The resistor R9 is also connected to a gate of the transistor Q1, which has the Zener diode G across the gate and a source. A drain of the transistor Q1 is connected to the primary winding (pin 5) of the transformer T1. The source of the transistor Q1 is also connected to the parallel combination of the resistors R10 and R33. The parallel combination of the resistors R10 and R33 is connected, on one side, to ground, and on the other side, in addition to the source of the transistor Q1, to the CS input.

A zero current detector input (pin 5) of the controller U1 is connected to the resistor R13. The resistor R13 is also connected to the AUX input and to the feedback winding (pin 2) of the transformer T1, which is also connected to ground (at pin 1).

At startup, the controller U1 receives two signals at the multiplier pin (pin3) and the VCC input pin (pin 8). The voltage at the VCC input pin (pin 8) begins to increase from zero as the capacitors C1, C7, and C14 begin to charge with current supplied by the DC voltage generated by the front end circuit 210' through the resistor R6. The controller U1 then starts supplying pulses to the transistor Q1 from the gate driver output pin (pin 7) through the resistor R9, forcing current into the primary winding of the transformer T1 through the transistor Q1. When the transistor Q1 turns off, the feedback winding (pins 1-2) of the transformer T1 "flyback" and supply current through the diodes D1 and D2, charging the capacitors C1, C2, C7, and C14. That is, the first LED drive circuit 212' starts generating VCC internally. The controller U1 is reset by monitoring the voltage on the zero current detector input pin (pin5) of the controller U1 through the resistor R13. The current through the transistor Q1 is limited by the combination of the voltage at the multiplier input pin (pin3) of the controller U1 and a voltage produced by an error amplifier configured between the inverting and compensation inputs of controller U1 (pins 1 and 2, respectively). The error amplifier, which includes the resistors R7 and R8 and the capacitor C12, as described above, acts as a compensation network to achieve stability in the voltage control loop and to ensure high power factor and low THD. In some embodiments, the power output of the first LED drive circuit 212' is set by the resistors R10 and R33, which are coupled to the PWM comparator input pin of the controller U1 (pin 4), as described above.

Figure 4:
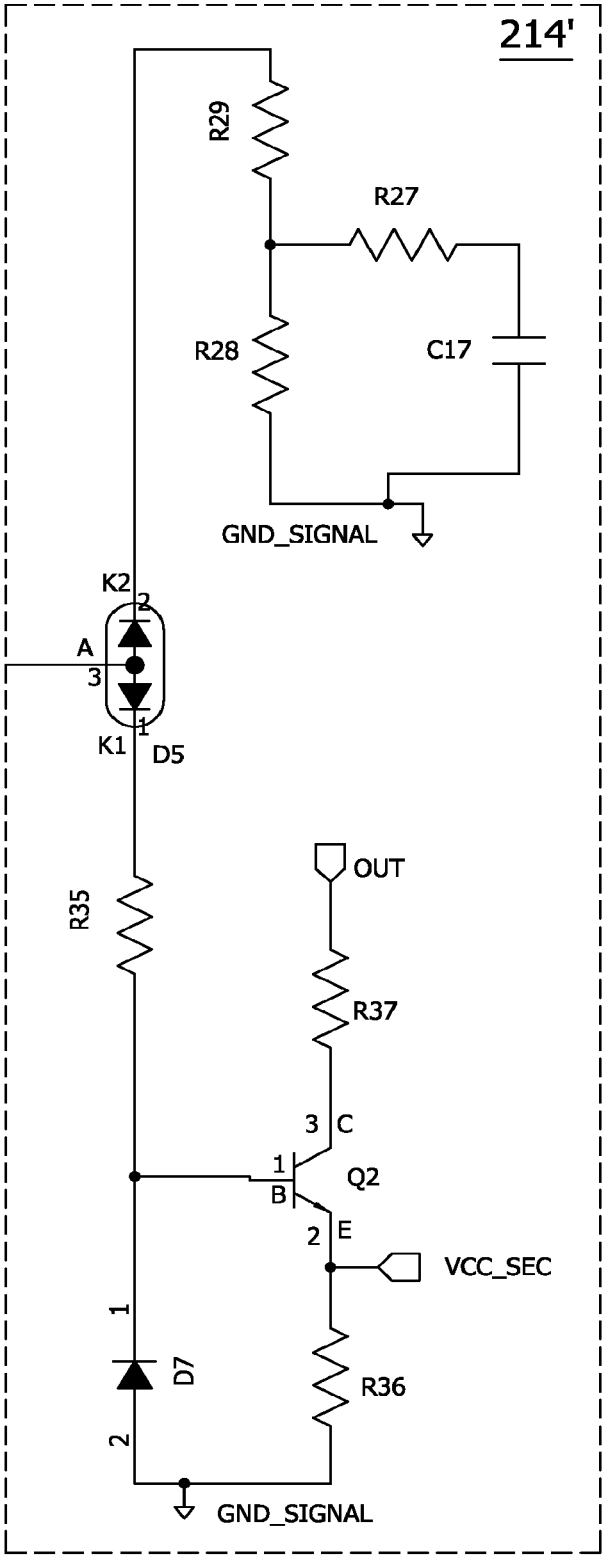
FIG. 4 illustrates a circuit diagram of a dimmer sense circuit of a dimmable multichannel driver according to embodiments disclosed herein.

FIG. 4 is a circuit diagram of the dimmer sense circuit 214', which includes, for example, a two-diode package D5, a diode D7, resistors R27-R29 and R35-R37, and a transistor Q2. The two-diode package D5 is connected to the secondary winding of the transformer T1 of the first LED drive circuit 212' shown in FIG. 4. The capacitor C17 is connected in series with the resistor R27. The resistor R28 is connected across the series connection of the capacitor C17 and the resistor R27. On one side, the parallel combination of the resistor R28 with the resistor R27 and the capacitor C17 is connected to a GND_SIGNAL, and on the other side, to the two-diode package D5. The resistors R27-R29 and the capacitor C17 behave as a triac sensing circuit, that receives the voltage signal from the secondary winding of the transformer T1. Once a dimmer 204 is connected at the primary AC input (e.g., the inputs J1 and J2 of the front end circuit 210' shown in FIG. 2), the phase cut voltage waveform will occur across the primary winding of the transformer T1. A voltage waveform of the same shape (e.g., a phase cut waveform) will also occur across the secondary winding of the transformer T1 through the winding ratio of the transformer T1. The triac sensing circuit will average those phase cut waveforms into a DC voltage (e.g., the dimmer sense voltage), which is provided as a reference signal to the master controller 216/216'. A change in the phase of the input voltage will cause an image change in the dimmer sense voltage.

The two-diode package D5 is also connected to the resistor R35. The resistor R35 is also connected to a cathode of the diode D7 and to a base of the transistor Q2. An anode of the diode D7 and the resistor R36 are connected to the GND_SIGNAL. The resistor R36 is also connected to an emitter of the transistor Q2, and to a VCC_SEC output. The resistor R37 is connected between a collector of the transistor Q2 and an OUT output. Thus, the two-diode package D5 is configured to block current from flowing back into the secondary winding of the transformer T1 of the first LED drive circuit 212'. The resistors R35-R37, the diode D7, and the transistor Q2 are configured to regulate an operational voltage (VCC) for the master controller 216' and the second LED drive circuit 220'.

Figure 5:
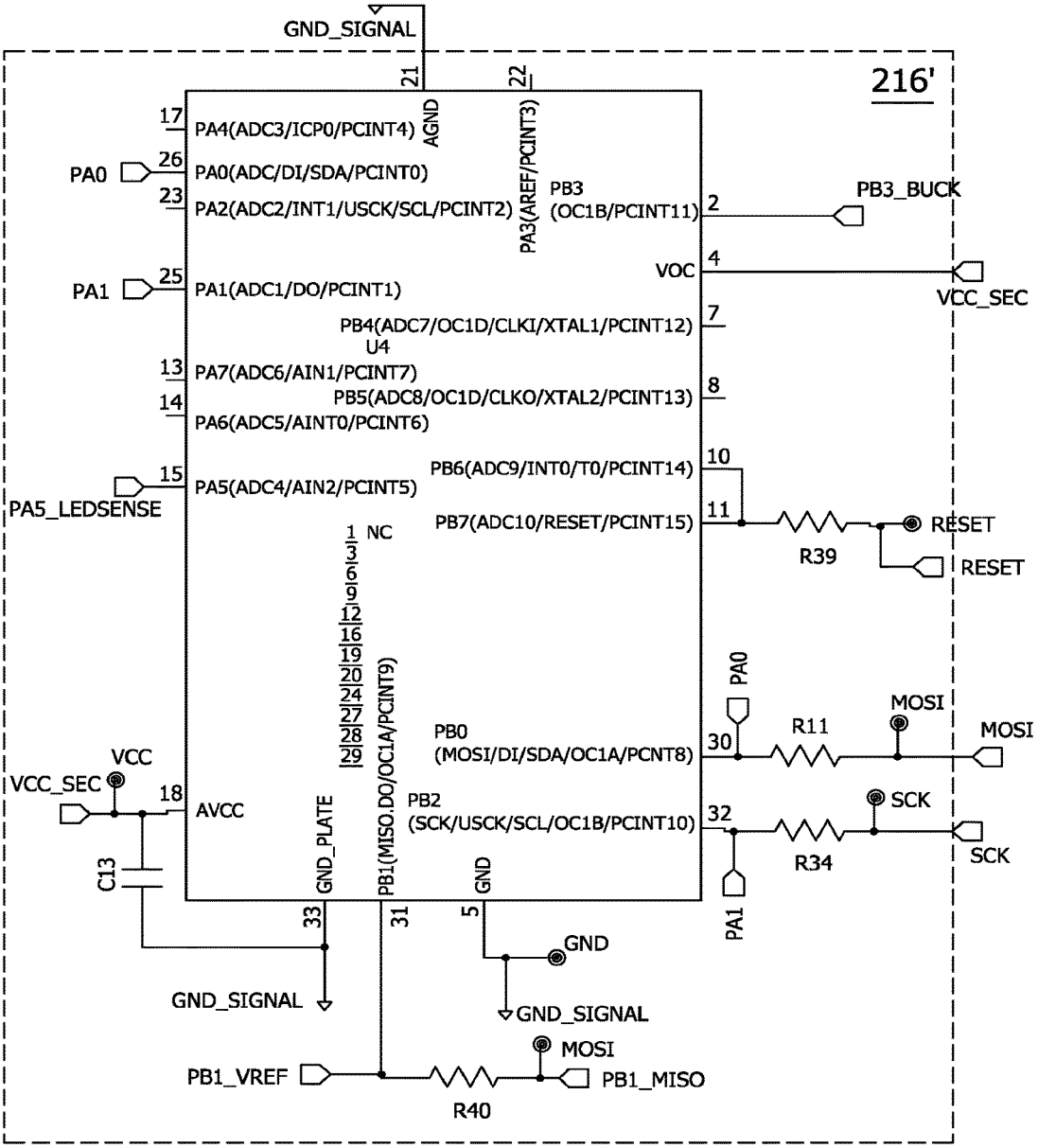
FIG. 5 illustrates a circuit diagram of a master controller of a dimmable multichannel driver according to embodiments disclosed herein.

FIG. 5 is a circuit diagram of the master controller 216'. In FIG. 5, the master controller 216' is an ATtiny261A microcontroller manufactured by the Atmel Corporation, however, embodiments are not limited to implementation using only this microcontroller. Components configured around, or coupled to, the master controller 216', but not specifically described herein, may be particular to the operational requirements of the ATtiny261A. As stated above, VCC may be supplied to the master controller 216' by the dimmer sense circuit 214', via the VCC_SEC output. After VCC increases to a level sufficient for activation, the master controller 216' proceeds to execute instructions stored within a memory of the master controller 216'. In some embodiments, these instructions provide for the control of the first LED load 206 and the second LED load 208—based on, for example, the dimmer sense voltage. Examples of operation wherein the master controller 216' controls these loads are described further in regard to FIGS. 6-8. The master controller 216' includes a number of pins, some of which have no connections in embodiments of the present invention. In FIG. 5, pin 21 is connected to the GND_SIGNAL, pin 2 is connected to a PB3_BUCK, pin 4 is connected to the VCC_SEC output, pin 26 is connected to a PA0, and pin 25 is connected to a PA1. Pins 10 and 11 are connected to each other, and to a resistor R39. The resistor R39 is also connected to a RESET pin and a RESET. Pin 15 is connected to a PA5_LEDSENSE. Pin 18 is connected to the VCC_SEC output and to a VCC, as well as to a capacitor C13. The capacitor C13 is also connected to pin 33, which is also connected to the GND_SIGNAL. Pin 31 is connected to a PB1_VREF and to a resistor R40. The resistor R40 is also connected to a PB1_MISO and to a MISO input. Pin 5 is connected to a GND and to the GND_SIGNAL. Pin 32 is connected to the PB1 and to a resistor R34. The resistor R34 is also connected to an SCK input and to an SCK. Pin 30 is connected to the PA0 and to a resistor R11. The resistor R11 is connected to the MISO input and to an MOSI.

Figure 6:
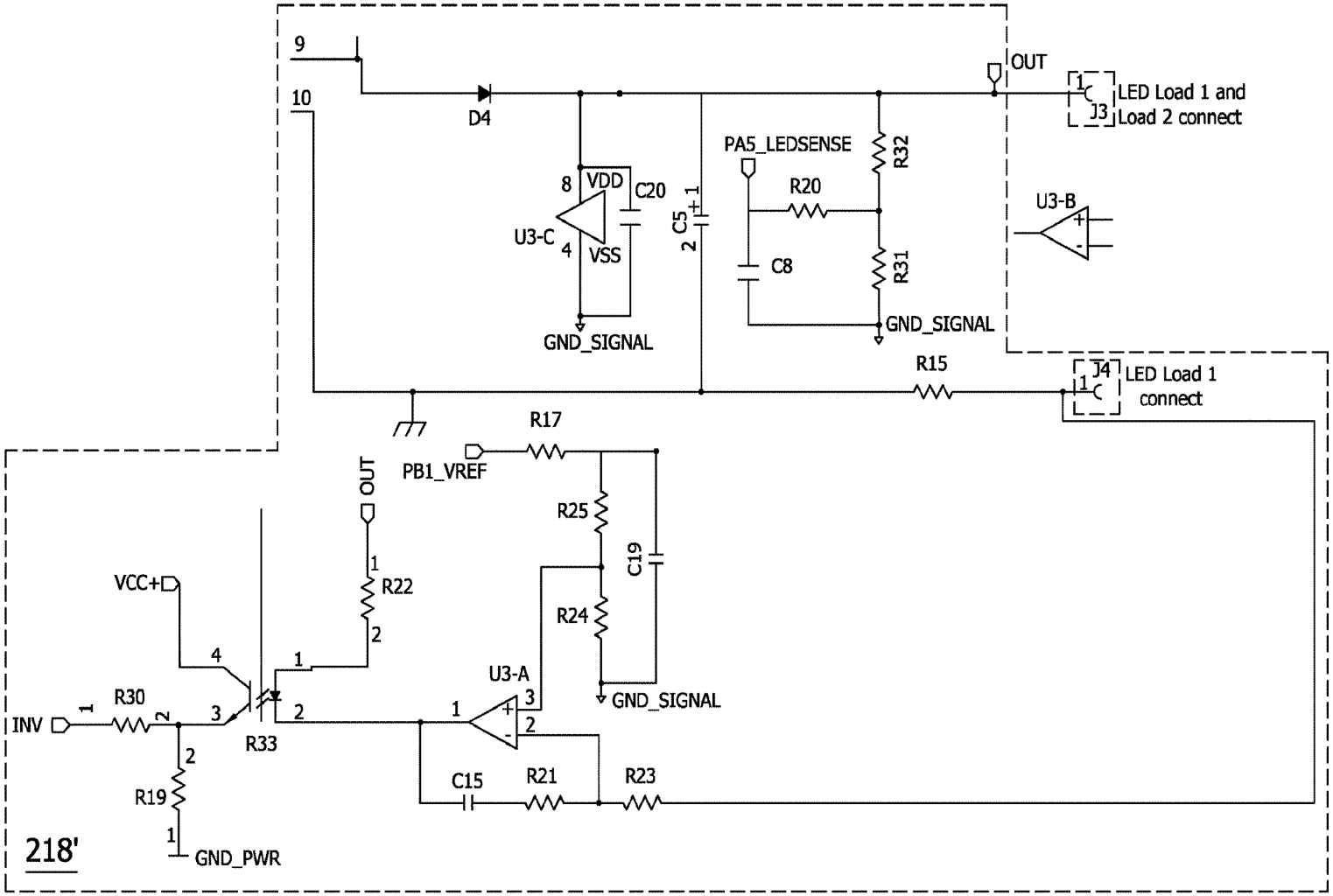
FIG. 6 illustrates a circuit diagram of a feedback and control circuit of a dimmable multichannel driver according to embodiments disclosed herein.

FIG. 6 is a circuit diagram of a feedback and control circuit 218'. The feedback and control circuit 218' includes, for example, a diode D4, operational amplifiers (a.k.a. "op-amps") U3-A, U3-B, and U3-C, capacitors C5, C15, and C19-C20, an optoisolator U2, resistors R15, R17, R19, R21, R23-R25, and R31-R32. An anode of the diode D4 is connected to the transformer T1 of the first LED drive circuit 212'. A cathode of the diode D4 is connected to the op-amp U3-C, to the capacitor C5, to the resistor R32, to the OUT output, and a terminal J3. The capacitor C20 is connected across the op-amp U3-C, and is connected to the GND_SIGNAL. The capacitor C5 is also connected to ground, to the transformer T1, and to the resistor R15. The resistor R15 is also connected to a terminal J4 and to the resistor R23. The resistor R32 is also connected to the resistor R20 and to the resistor R31. The resistor R31 is also connected to the capacitor C8 and to GND_SIGNAL. The capacitor C8 is also connected to the resistor R20 and to the PA5_LEDSENSE. The resistor R23 is also connected to the resistor R21 and to an inverting input of the op-amp U3-A. The resistor R21 is also connected to the capacitor C15. The capacitor C15 is also connected to an output of the op-amp U3-A and to a cathode of the optoisolator U2. The resistor R17 is connected to the PB1_VREF and to the resistor R25 and to the capacitor C19. The capacitor C19 is connected to the resistor R24 and to the GND_SIGNAL. The resistor R24 is connected to the resistor R25, and both are connected to a non-inverting input of the op-amp U3-A. An anode of the optoisolator U2 is connected to the resistor R22. The resistor R22 is also connected to the OUT output. The resistor R30 is connected to the INV input and to the resistor R19 and to the optoisolator U2. The resistor R19 is also connected to the GND_PWR. The optoisolator U2 is also connected to the VCC+ input.

The first LED load 206 and the second LED load 208 are coupled to the terminal J3 of the feedback and control circuit 218', with the current for driving both loads being supplied by the diode D4. The capacitor C5 is configured to reduce the voltage swing on the first LED load 206 and the second LED load 208, and provides power to the op-amp U3-C as well as to the second LED drive circuit 220'. The resistors R20, R31, and R32 and the capacitor C8 are configured to operate as a voltage sensing circuit by generating a voltage corresponding to the voltage across the first LED load 206. The resistors R17, R24, and R25, and the capacitor C19 are configured to generate a DC reference voltage to the non-inverting input of the op-amp U3-A (pin 3). In some embodiments, the master controller 216' monitors the voltage corresponding to the voltage across the first LED load 206 generated by the voltage sensing circuit, makes a determination as to whether the voltage across the first LED load 206 requires adjustment (e.g., if the voltage is too low to generate the desired light output from the first LED load 206), and if determined to be required, adjusts a first PWM signal being provided by the master controller 216' (e.g., from the PB1_VREF) to the reference voltage circuit, which generates the reference voltage based on the first PWM signal.

The first LED load 206 may be, and in some embodiments is, further coupled to the terminal J4 in the feedback and control circuit 218'. In some embodiments, the first LED load 206 includes a string of solid state light sources connected between the terminals J3 and J4. The drive current flowing through first LED load 206 (e.g., in through the terminal J3 and out to the terminal J4) is then directed to flow through the resistor R15. The resistor R15 serves as a current sensing resistor. The voltage across the resistor R15 is compared to the reference voltage on the non-inverting input of the op-amp U3-A, the operation of which is stabilized by a negative feedback loop including the resistors R2 and R23 and the capacitor C15. The output of the op-amp-U3-A (pin 1) determines the on-off operation of the optoisolator U2. For example, when the output of the op-amp U3-A is low, current flows through the solid state light source inside the optoisolator U2, causing the solid state light source to illuminate and to send a signal across to a primary side of the optoisolator U2. This on-off signal sends a message to the INV input, which is connected to pin 1 of the controller U1 in the first LED drive circuit 212' to start or stop sending power to the secondary of the transformer T1. In this manner, the drive current flowing to the first LED load 206 and to the second LED load 208 is controlled.

Figure 7:
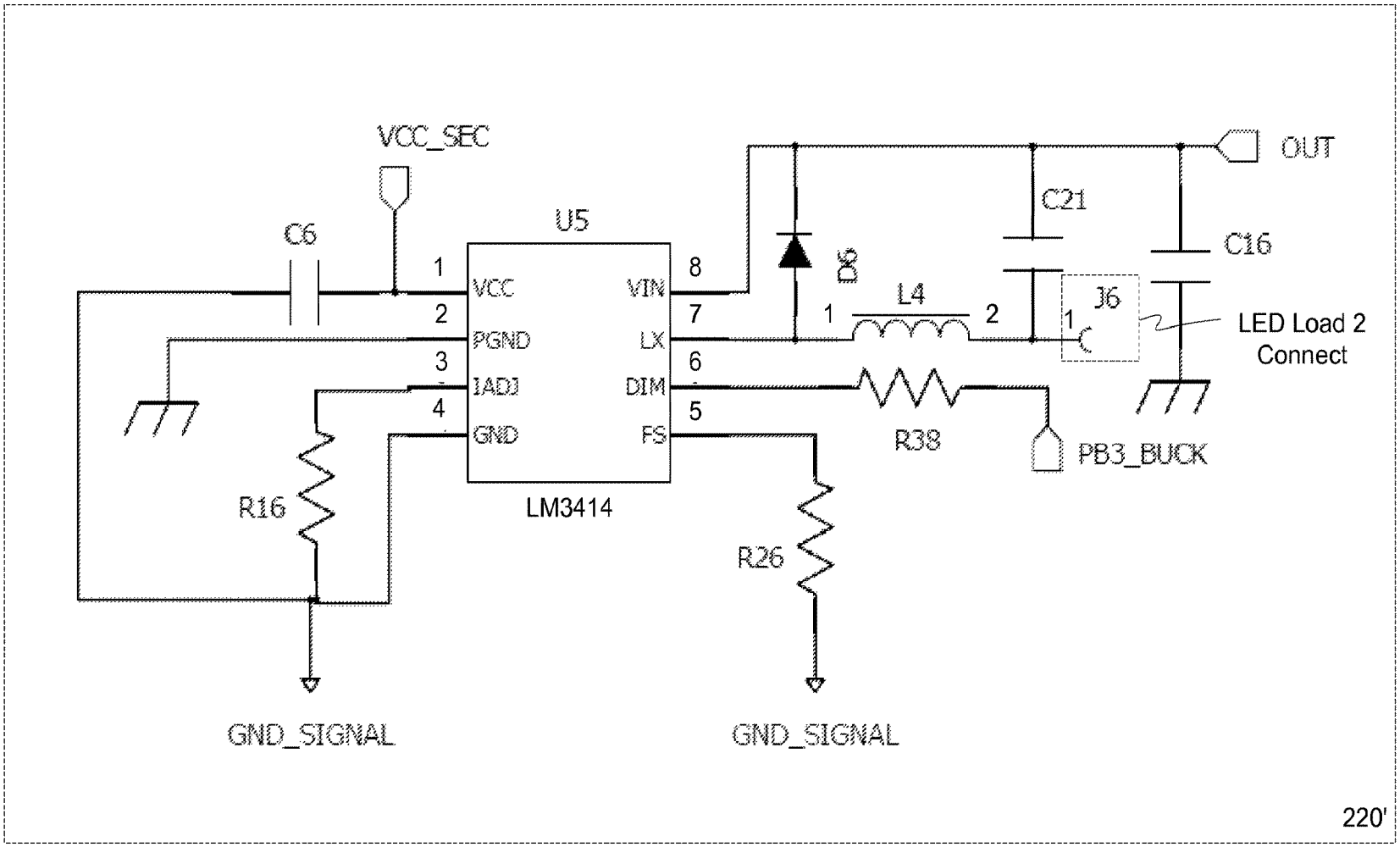
FIG. 7 illustrates a circuit diagram of a second solid state light source drive circuit of a dimmable multichannel driver according to embodiments disclosed herein.

FIG. 7 is a circuit diagram of the second LED drive circuit 220', which includes, for example, capacitors C6, C16, and C21, an inductor L4, resistors R16, R26, R38, a diode D6, and a controller U5. In FIG. 7, the controller U5 is an LM3414 buck controller manufactured by National Semiconductor Corporation, though of course other controllers may be, and in some embodiments are, used. As stated above, components configured around, or coupled to, the controller U5, but not specifically described herein, may be particular to the operational requirements of the LM3414. The controller U5 has eight pins. Pin 5 is connected to a resistor R26. The resistor R26 is also connected to the GND_SIGNAL. Pin 6 is connected to a resistor R38. The resistor R38 is connected to the PB3_BUCK. Pin 54 is connected directly to GND_SIGNAL. Pin 3 is connected to a resistor R16. The resistor R16 is also connected to GND_SIGNAL. Pin 2 is connected to ground. Pin 1 is connected to the VCC_SEC and to the capacitor C6. The capacitor C6 is also connected to GND_SIGNAL. Pin 8 is connected to a cathode of a diode D6, to the capacitor C21, to the capacitor C16, and to the output OUT. The capacitor C16 is also connected to ground. The capacitor C21 is also connected to a terminal J6. Pin 7 is connected an anode of the diode D6 and to the inductor L4. The inductor L4 is connected to the capacitor C21 and to the terminal J6. In some embodiments, the second LED load 208 is a string of solid state light sources coupled to (and receiving drive current from) the terminal J3 in the feedback and control circuit 218'. The other end of the second LED load 208 is coupled to the terminal J6 of the second LED drive circuit 220', allowing the second LED drive circuit 220' to control the flow of the drive current. Operational voltage generated by the resistors R35, R36, and R37, the diode D7, and the transistor Q2 in the dimmer sense circuit 214' is provided as VCC to the controller U5 via the OUT output connected to pin 8. In some embodiments, on activation of the power supply circuit 202', VCC will increase to a level allowing the controller U5 to activate, which causes the controller U5 to switch on an internal MOSFET (not shown in FIG. 7) and to start drawing drive current from the second LED load 208 through the inductor L4. Once the internal MOSFET inside the controller U5 turns off, the energy stored in the inductor L4 will discharge through the diode D6 and supply the current to the second LED load 208. Thus, the drive current flowing through the second LED load 208 will be controlled by the switching operation of the controller U5. The switching of the controller U5 may, in turn be controlled by a second PWM signal generated by the master controller 216' to pin 6 on the controller U5 (via the PB3_BUCK). For example, altering the duty cycle of the second PWM signal may reduce or increase the amount of drive current allowed to flow through the second LED load 208. In this manner, output characteristics of second LED load 208, such as but not limited to brightness, may be controlled as a percentage of the output characteristics, such as but not limited to brightness, of the first LED load 206. When the first LED load 206 and the second LED load 208 contain solid state light sources of different colors (for example but not limited to white solid state light sources and amber solid state light sources), the light output of each load may be controlled to generate a desired combined light color temperature.

In some embodiments, the master controller 216' is configured to determine the setting of the dimmer 204 based on the dimmer sense voltage provided by the dimmer sense circuit 214'. The master controller 216' then generates a first PWM signal to set the reference voltage in the feedback and control circuit 218' and a second PWM to control the second LED drive circuit 220'. In the event of very low current flowing through the first LED load 206, the master controller 216' may detect the situation through a drop in voltage corresponding to the voltage across the first LED load 206 (as generated in the feedback and control circuit 218'), and may then set a new reference voltage that causes the first LED drive circuit 212' to generate more drive current. In this manner, the first LED load 206 may be prevented from inadvertently turning off. In the event of start-up, the master controller 216' may detect a low voltage corresponding to the voltage across the first LED load 206 and may set a new reference voltage to generate more power from the first LED drive circuit 212'. After the voltage corresponding to the voltage across the first LED load 206 rises above the reference voltage, the master controller 216' may sense the dimmer setting and may determine the current of both the first LED load 206 and the second LED load 208 as a continuous loop.

Figure 8:
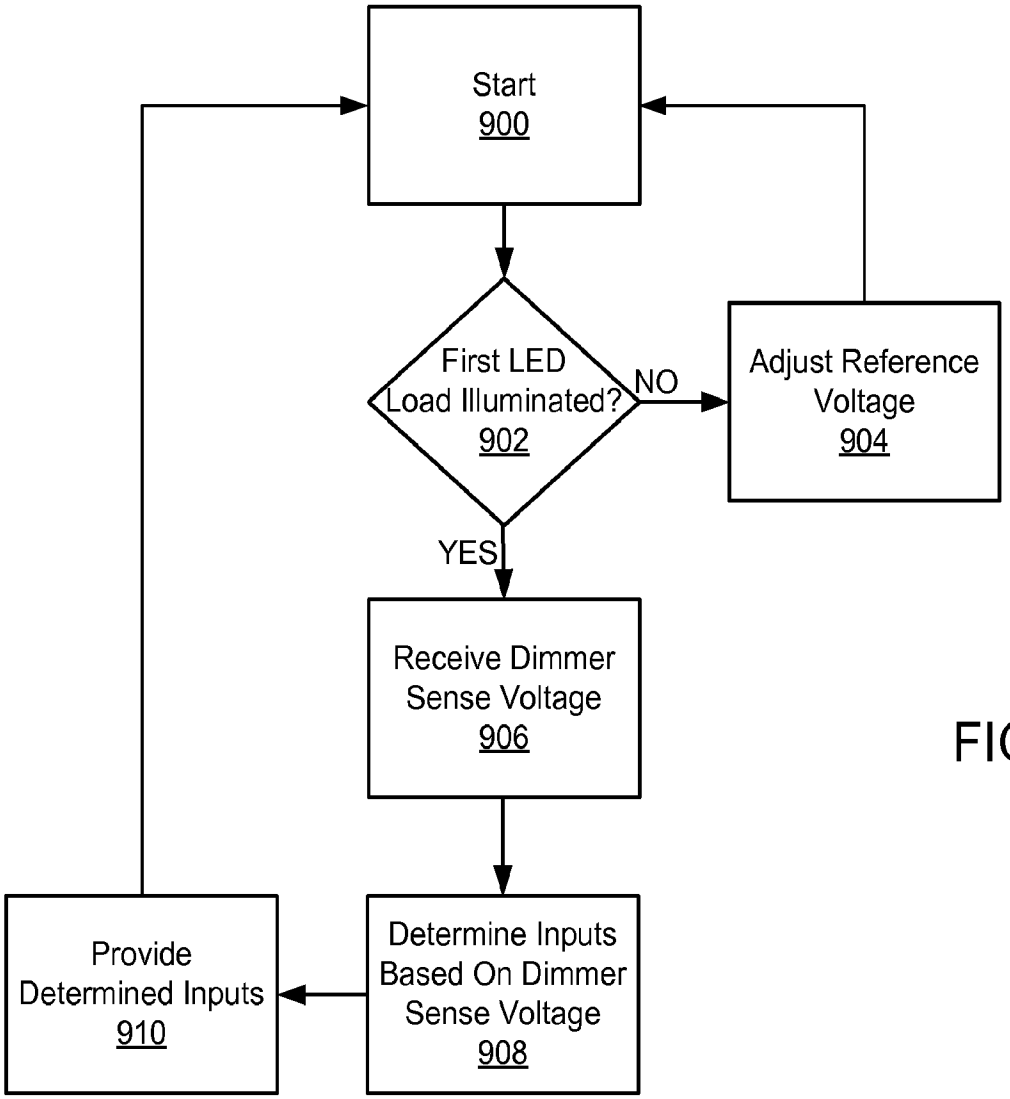
FIG. 8 illustrates a flowchart of a method of dimming solid state light source according to embodiments disclosed herein.

FIG. 8 illustrates a flowchart of operations for a dimmable multichannel solid state light source drive/power system, as described throughout. Following startup in operation 900, a master controller in a power supply circuit is configured to determine whether a first LED load is illuminated. The determination of whether the first LED load is illuminated is based on, for example but not limited to, a voltage generated by feedback and control circuit in the power supply circuit, the voltage corresponding to the voltage across the first LED load, which may be generated in a feedback and control circuit, as described above. If in operation 902 it is determined that the first LED load is not illuminated, then in operation 904 the master controller may adjust a reference voltage. For example, the master controller may increase the duty cycle of a first PWM signal, which may cause the reference voltage to increase in the feedback and control circuit. The increase in reference voltage may cause first LED drive circuit in the power supply circuit to generate more drive current for illuminating the first LED load.

If in operation 902 it is determined that the first LED load is illuminated, then in operation 905, the master controller receives a dimmer sense voltage. The dimmer sense voltage is generated by a dimmer sense circuit in the power supply circuit, and may correspond to the setting of an AC dimmer coupled to the power supply circuit. In operation 908, the master controller determines inputs based on the dimmer sense voltage. For example, the master controller may be configured to select inputs (e.g., duty cycle settings for PWM signals) from predetermined settings in the master controller based on the dimmer sense voltage. In operation 910, the master controller provides the inputs determined in operation 908 to, for example, the feedback and control circuit and/or the second LED drive circuit in the power supply circuit. The inputs may be, for example, first and second PWM signals. Operation 910 may then be followed by a return to operation 900 to restart the flow of operations.

While FIG. 8 illustrates various operations according to embodiments, it is to be understood that not all of the operations depicted in FIG. 8 are necessary for other embodiments. Indeed, it is fully contemplated herein that in other embodiments, the operations depicted in FIG. 8, and/or other operations described herein, may be combined in a manner not specifically shown in any of the drawings, but still fully consistent with the present disclosure. Thus, claims directed to features and/or operations that are not exactly shown in one drawing are deemed within the scope and content of the present disclosure.

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer(s), workstation(s) (e.g., Sun, HP), personal digital assistant(s) (PDA(s)), handheld device(s) such as cellular telephone(s) or smart cellphone(s), laptop(s), handheld computer(s), or another device(s) capable of being integrated with a processor(s) that may operate as provided herein. Accordingly, the devices provided herein are not exhaustive and are provided for illustration and not limitation.

References to "a microprocessor" and "a processor", or the "microprocessor" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A method, comprising:

determining if a first solid state light source load driven by a first drive circuit is illuminated based on a voltage corresponding to the voltage across the first solid state light source load generated in a feedback and control circuit; and controlling, via a master controller, the first drive circuit and a second drive circuit, such that:

the first drive circuit is controlled based on the voltage corresponding to the voltage across the first solid state light source load by adjusting a reference voltage in the feedback and control circuit, wherein adjusting the reference voltage comprises adjusting a first pulse width modulation (PWM) signal provided to the feedback and control circuit to generate the reference voltage; and the second drive circuit drives a second solid state light source load and is controlled by providing a second PWM signal from the master controller, wherein the second PWM signal has a second duty cycle determined based on a dimmer sense voltage;

wherein a current through the second solid state light source load is set, via the controlled second drive circuit, to a value less than a current through the first solid state light source load, such that light emitted by the first solid state light source load and the second solid state light source load is combined to result in a desired color temperature.

2. The method of claim 1, wherein determining comprises:

determining if the first solid state light source load driven by a direct current (DC) to DC flyback circuit is illuminated based on the voltage corresponding to the voltage across the first solid state light source load generated in the feedback and control circuit, wherein the DC to DC flyback circuit includes a DC to DC flyback converter controller;

and wherein controlling comprises:

controlling the DC to DC flyback circuit based on the voltage corresponding to the voltage across the first solid state light source load by adjusting the reference voltage in the feedback and control circuit.

3. The method of claim 1, further comprising:

receiving the dimmer sense voltage from a dimmer sense circuit;

determining a first duty cycle for the first PWM signal based on the dimmer sense voltage; and providing the first PWM signal at the first duty cycle to the feedback and control circuit.

4. The method of claim 1, wherein controlling the second drive circuit comprises:

controlling a DC to DC buck controller, the DC to DC buck controller being configured to control the drive current for the second solid state light source load based on the second PWM signal.

5. The method of claim 3, wherein determining the first duty cycle and determining the second duty cycle comprises:

selecting a first frequency for the first PWM signal and a second frequency for the second PWM signal, wherein each frequency is selected from predetermined settings stored in a master controller, and wherein each frequency is selected based on the dimmer sense voltage.

6. The method of claim 5, wherein selecting comprises:

selecting a first frequency for the first PWM signal and a second frequency for the second PWM signal, wherein each frequency is selected from predetermined settings stored in the master controller, wherein each frequency is selected based on the dimmer sense voltage, and wherein the predetermined settings are configured to cause the first solid state light source load and the second solid state light source load to generate light, that when combined, corresponds to a certain light color temperature.

7. The method of claim 6, wherein selecting comprises:

scaling, via the master controller, the dimmer sense voltage to a level that corresponds to a record including the predetermined settings in the master controller, such that the record includes values for the first drive circuit and the second drive circuit that result in light generated by the first solid state light source load and the second solid state light source load to correspond to a desired light color temperature.

* * * * *